United States Patent [19]

Dalla Vecchia

[11] 3,950,968

[45] Apr. 20, 1976

[54] FABRIC WASHING MACHINE WITH CONTINUOUS FEED SYSTEM

[75] Inventor: Gino Dalla Vecchia, Santorso, Italy

[73] Assignee: Rimar S.p.A., Trissino, Italy

[22] Filed: Nov. 20, 1974

[21] Appl. No.: 525,456

[30] Foreign Application Priority Data

Nov. 21, 1973 Italy ..... 31503/73

[52] U.S. Cl. ..... 68/53; 68/178

[51] Int. Cl.[2] ..... D06B 3/10

[58] Field of Search ..... 68/28, 53, 147, 175, 68/177, 178, 179, 184, 190, DIG. 1

[56] References Cited

UNITED STATES PATENTS 3,631,692 1/1972 Garzotto ..... 68/178 X

*Primary Examiner*—Robert W. Jenkins
*Assistant Examiner*—Philip R. Coe
*Attorney, Agent, or Firm*—Finnegan, Henderson, Farabow & Garrett

[57] ABSTRACT

A fabric washing machine with a continuous feeding system, particularly useful for washing delicate fabrics such as gabardine, jersey and the like, comprises a stationary tank containing a solvent or liquid detergent and provided with an upper and lower row of fixed blades. In the interspace defined between the outer ends of these blades a stationary washing drum with apertured walls is housed, and two plurality of blades are mounted respectively above and below the drum in correspondence with the two rows of fixed blades, being adapted to oscillate so that each blade can move between two adjacent stationary blades.

9 Claims, 3 Drawing Figures

FABRIC WASHING MACHINE WITH CONTINUOUS FEED SYSTEM

BACKGROUND OF THE INVENTION

The present invention concerns a fabric washing machine with a continuous feeding system, particularly useful in the industrial field for the washing of delicate fabrics such as gabardine, jersey, etc.

It is well known that washing machines, both for industrial and domestic use, carry out the cleaning operation by subjecting the fabric to a mechanical action, more or less intense, to afford violent contact with the water or solvent.

Most machines according to the prior art perform the necessary relative motion between the solvent and fabric by means of a rotatory oscillating movement of the tub containing fabrics and solvent. Obviously this rotatory action of the tub subjects the fabrics to irregular and often heavy pressures.

The machines known for washing fabrics with a continuous feeding system are generally of the type in which the fabric is immersed and made to pass through a solvent bath by means of guide rollers. The results of this type of washing machine are not however satisfactory, in that the solvent carries out an insufficient mechanical action on the fabrics. A washing machine with a continuous feed system which affords an excellent mechanical washing action is that described in the U.S. Pat. No. 3,631,692 of Garzotto and assigned to the present Assignee.

However it has been found that, because of the oscillations to which is subjected the washing drum, the fabrics contained therein, in particular delicate fabrics such as gabardine, textured jersey, etc, are subjected to streaks and undesired stresses.

SUMMARY OF THE INVENTION

It is an object of the present invention to provide a fabric washing machine with a continuous feed system in which the condition of relative motion between the internal walls of the drum and the fabrics contained therein is extremely reduced, so as to eliminate the rubbing to which the fabrics are normally subjected, while maintaining unaltered and undiminished the necessary mechanical action carried out by the solvent on the fabrics.

Another object of the present invention is to provide a machine which, in spite of the simplicity of its construction and operation, ensures an excellent wash of the fabrics which are almost exclusively subjected to the mechanical action of the solvent without being affected by a sensible dynamic action of the internal walls of the drum in which they are immersed, being therefore washed in absence of undesired stresses and streaks.

The washing machine according to the present invention, comprising a stationary tank suitable to contain solvent or liquid detergent and having fixed thereto two rows of blades, the first of which is integral with its upper delimiting wall and the second integral with its lower delimiting wall, and a washing drum housed in the interspace between these two rows of blades being provided with two perforated delimiting walls, respectively upper and lower, is substantially characterized in that the washing drum is stationary and there are provided two pluralities of blades, one positioned above and the other below the drum, each one in correspondence with one of said rows, there being also provided a means for supporting these blade pluralities and for driving them together in an oscillatory motion, by moving each of these blades along a path between two adjacent blades of one of the aforesaid rows.

BRIEF DESCRIPTION OF THE DRAWINGS

The present invention will be now described in greater detail with reference, by way of non-limitng example, to a preferred embodiment thereof, as illustrated in the annexed drawings, wherein.

DETAILED DESCRIPTION OF THE PREFERRED EMBODIMENT

Figure 1:
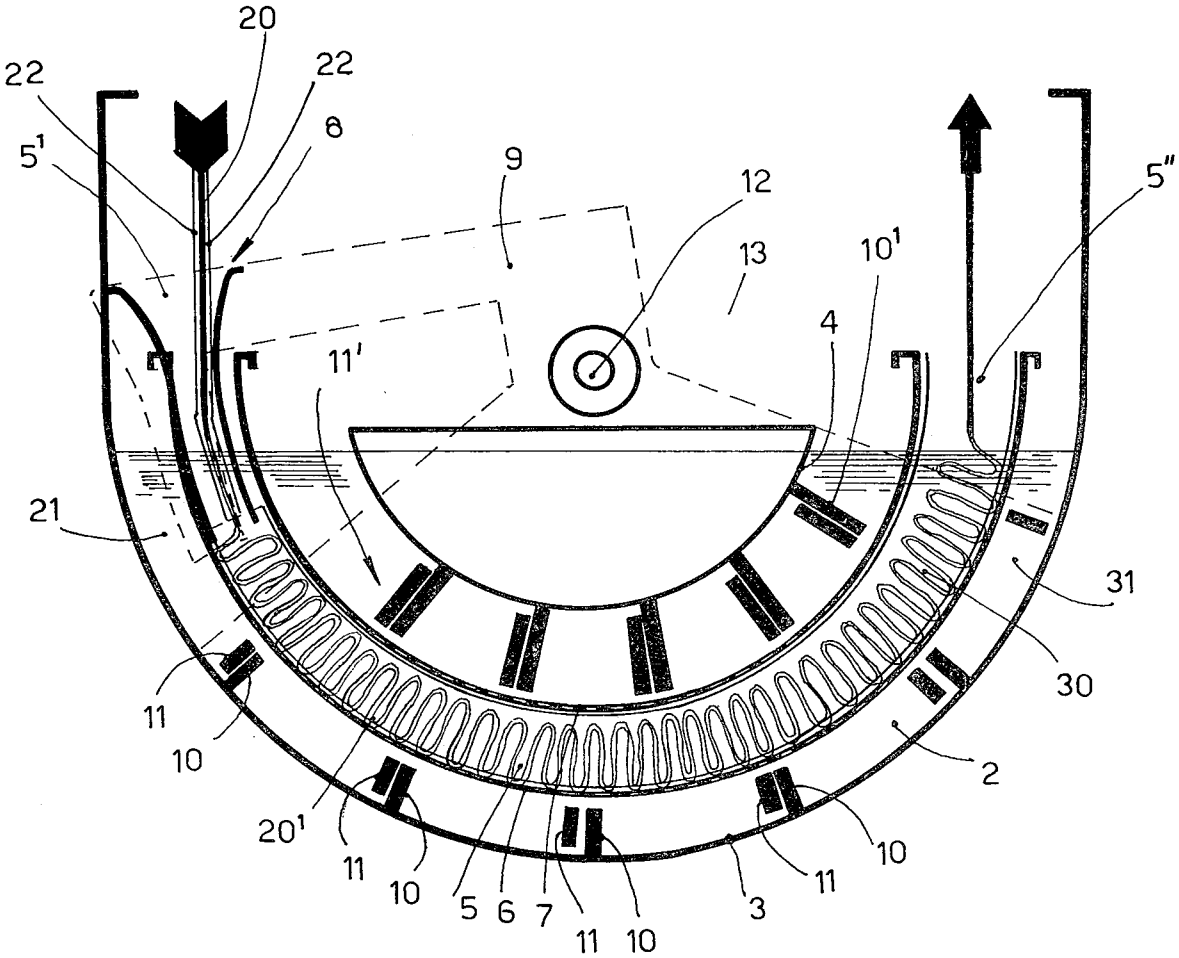
FIG. 1 is a view of the cross-section of a washing machine according to the present invention.

By making reference to FIG. 1, the machine according to the present invention is generally indicated with reference numeral 1, and comprises a washing tank 2 defined by a lower wall 3 and an upper wall 4, a washing drum 5 and a swinging arm 9, one end of which is fixed to an inlet plunger 8 and the other is integral to a wall 13 having fixed thereto two pluralities of blades, respectively 11 and 11'. Both the tank 2 and the drum 5 have in the embodiment shown, a U-shaped cross-section.

As evidenced in FIG. 1 showing the machine according to the present invention during its working action in a condition of feeding the fabric 20, also a tank 2 containing a solvent or other liquid detergent 21, is provided with two multiplicities of blades 10,10' fixed respectively, in a corresponding position, to its lower and upper wall 3 and 4. The mechanical action that the solvent effects on the fabric 20 is achieved by means of the appropriate arrangement of the two rows of stationary blades 10,10' with respect to the two movable pluralities 11,11'. In effect the drum 5, also being stationary and provided with perforated upper and lower walls, respectively 7,6, is crossed by the flow and ebb of the solvent 21, depending on the positions of the arm 9, swinging around a shaft 12 driven by a suitable multi-speed electric motor.

Figure 2:
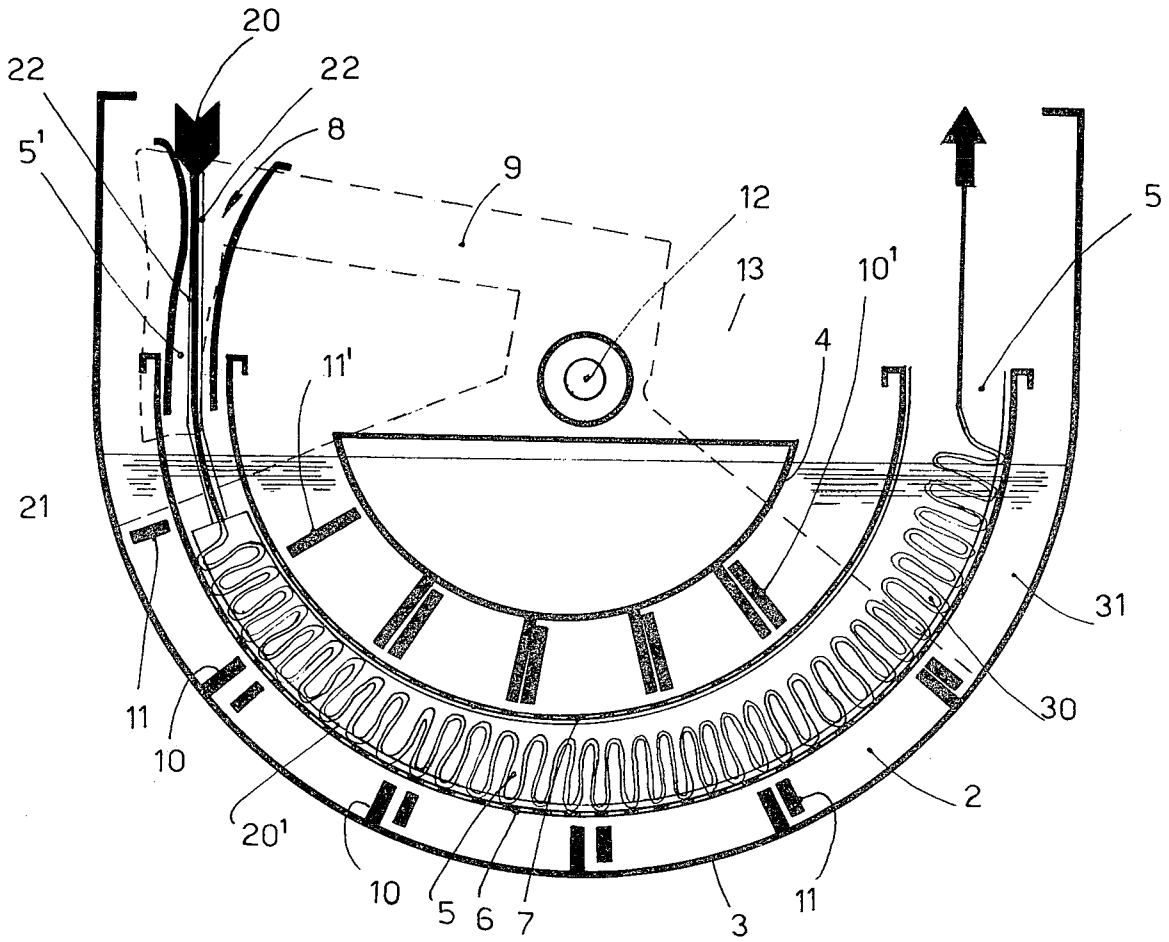
FIG. 2 is a cross-section view as in FIG. 1, but showing the machine in a different operation moment of its working cycle, and in FIG. 3 is a perspective view of the machine with its forward portion broken away for ease of illustration.
Figure 3:
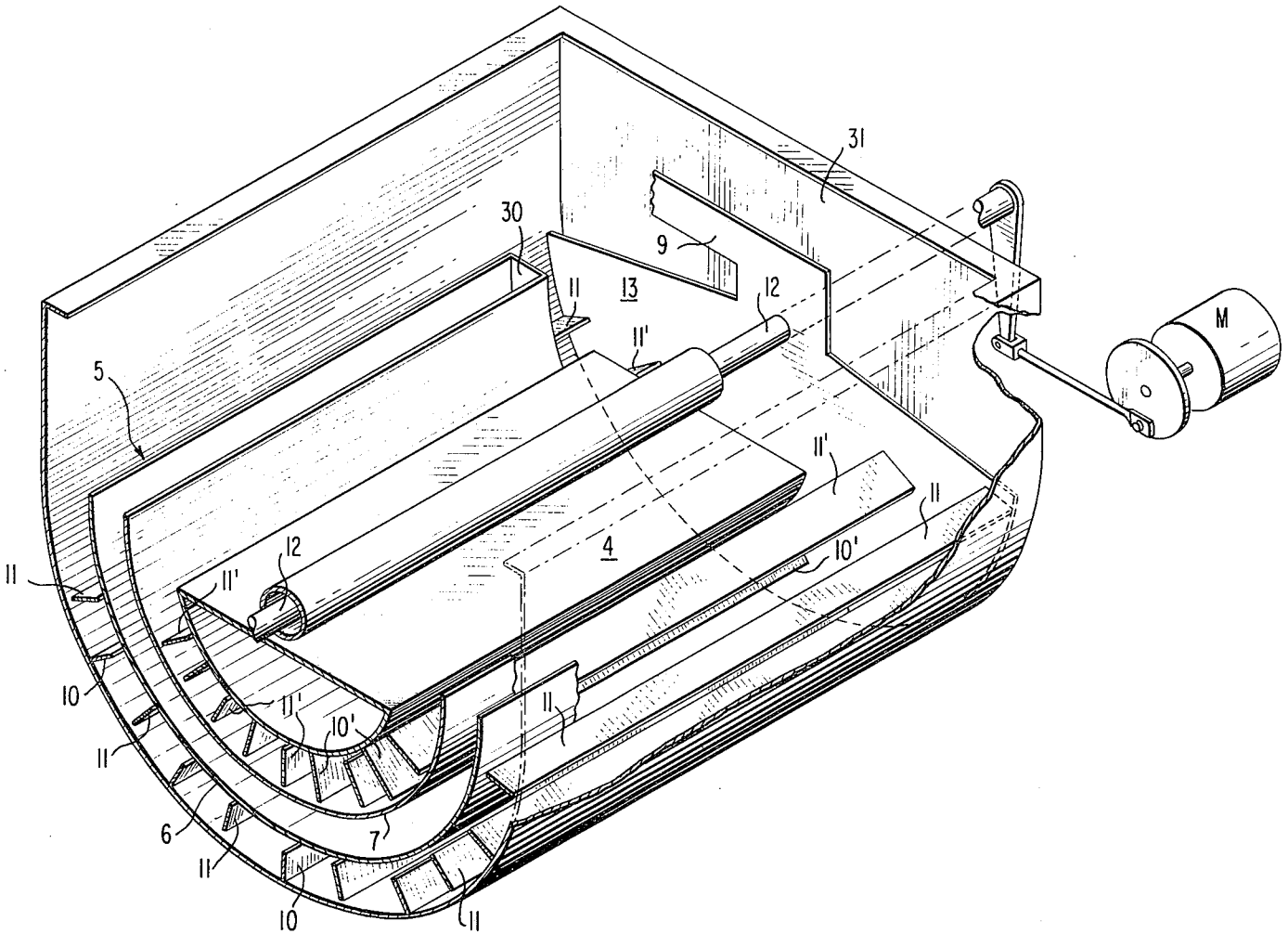

It is to be appreciated that the swinging movement of the blades 11,11' and the consequent variation of the volumes defined by the stationary and movable blades, gives rise with continuity to an unbalance of pressures, so that the solvent is forced to pass through the holes of walls 6,7 and to carry out an effective mechanical washing action on the fabric 20. In other words, the displacement of the solvent 21 is caused by the presence of continuously increasing and decreasing volumes, and due to the arrangement of stationary blades 10, 10' and of the movable blades 11,11'; the solvent periodicaly flows from these volumes comprised between blades 10' and 11' and walls 4,7 to those comprised between blades 10,11 and walls 3,6 thereby flowing through the drum 5 and the fabric 20 contained therein. Such effective action of the solvent is carried out yet while maintaining stationary the washing drum 5, hence reducing to the minimum the rubbing caused by the relative motion between the fabric 20 and the perforated walls 6,7. The plunger or funnel 8 is integral with the swinging arm 9 in the arrangement illustrated in FIG. 1, so as to co-operate with the feeding of the fabric 20 and the formation of the folds 20'. The funnel 8 gives also a thrust action on the fabric 20, in order to facilitate its gradual travel from the inlet 5' of the drum 5 to the outlet 5''. However the gradually increasing distance between the perforated walls 6,7 of the drum 5 in the direction from inlet 5' to outlet 5'' renders unnecessary the thrust action of the plunger funnel 8 on the fabric since this has the tendency to float because of its low specific weight when compared with the solvent 21. Consequently the plunger funnel 8 can also be not integral with the swinging arm 9 so as to render the oscillations of the movable blades 11,11' independent from the piston-type movements of the funnel 8. With reference to FIG. 1 it also appears that funnel 8 acts on the part of the fabric completely immersed in the drum 5, since at the inlet area and thereabove, two substantially vertical walls are provided, adapted to protect and guide the fabric 20, for causing it to assume the folded shape as shown in FIGS. 1 and 2. It is important to emphasize that the stationary arrangement of drum 5 not only eliminates the possible damage to the fabric caused by rubbing against the walls 6,7 of drum 5, but also allows the regular formation of folds 20', all of the same length, so as not to crumple the fabric being washed.

FIG. 2 shows the washing machine according to the present invention when the arm 9 has reached the stroke end position opposite to that shown in FIG. 1. At such position, the plunger or funnel 8 has reached the highest point of the path afforded it by the arm 9, and two blade pluralities have reached their minimum distance from the inlet zone 5'. Clearly the blade pluralities 10,10' and 11,11' are co-extensive with the full periphery length of drum 5, essentially comprised of two perforated semi-cylindrical surfaces 6,7 shown in cross-section views of FIGS. 1 and 2, and two delimiting lateral walls 30. The plurality of blades 11,11' can be fixed to a single mobile walls 13, positioned in the interspace between one of the lateral walls 30 of the drum 5 and the corresponding lateral wall 31 of tank 2, or preferably, two symmetrical walls 13 can be provided, both integral with and dependently extending from the swinging arm 9, thus providing for a more reliable support for the blades 11,11', which undergo pressures and depressions of hardly negligible values.

The washing machine according to the present invention at the upstream zone of drum 5 is further provided with several devices and mechanisms capable of guiding and pre-washing the fabric 20, and at downstream of drum 5 comprises means adapted to carry out the rinsing and drying of the washed fabric. A complete description of such devices is given in the U.S. Pat. No. 3,631,692.

Although the present invention is described in detail by making reference to the annexed drawings and to a preferred embodiment thereof, variations and/or modifications can be carried out by the skilled in the art without departing from the scope and spirit of the invention itself, as defined in the appended claims.

What I claim is:

1. A fabric washing machine comprising a stationary tank for containing a solvent or other liquid detergent and in part defined by spaced stationary upper and lower walls respectively, a stationary washing drum carried by said machine and disposed in the interspace between and space from the upper and lower walls of said tank, said drum including two spaced perforated upper and lower walls, respectively, a first fixed set of blades carried by said machine and disposed between the spaced upper walls of said tank and said drum respectively, a second fixed set of blades carried by said machine and disposed between the spaced lower walls of said tank and said drum respectively, first and second groups of a plurality of blades each, said first group of blades being located between the upper wall of said tank and the upper wall of said washing drum and substantially interleaved with said first set of blades, said second group of blades being located between the lower wall of said tank and the lower wall of said washing drum and substantially interleaved with said second set of blades, and means for supporting and oscillating said blade groups whereby the blades of each blade group move along paths between the blades of the corresponding sets of blades.

2. A washing machine according to claim 1 further including an element located adjacent corresponding end edges of the upper and lower walls and at one end of said washing drum, said element being carried by said machine for oscillating movement, means for oscillating said element whereby said element is adapted to push the fabric fed into said one end of said washing drum for discharge of the fabric at the opposite end thereof from between the corresponding opposite end edges of said washing drum.

3. A washing machine according to claim 2 wherein each of said tank and said drum has opposite end walls, said support means including at least one support wall disposed between one of the end walls of said tank and the corresponding end wall of said washing drum and carrying said blade groups for oscillating movement, and means coupling said element and said one support wall for joint oscillating movement of said element and said blades, said oscillating means including an electric motor.

4. A washing machine according to claim 1 wherein each of said tank and said drum has opposite end walls, said each of said tank and said drum has opposite end walls, said support means including at least one support wall disposed between one of the end walls of said tank and the corresponding end wall of said washing drum and carrying said blade groups for oscillating movement.

5. A washing machine according to claim 4 wherein said support means includes a second support wall generally parallel to said one end wall and disposed between the other end wall of said tank and the other corresponding end wall of said drum, said blade groups being carried by and disposed between the support walls.

6. A washing machine according to claim 1 wherein said first and second sets of blades are respectively fixed to the upper and lower walls of said tank and project toward one another.

7. A washing machine according to claim 6 wherein the upper and lower walls of each of said tank and said drum are arcuate and lie along portions of substantially concentric circles.

8. A washing machine according to claim 1 wherein said first and second sets of blades are respectively fixed to the upper and lower walls of said tank and project toward one another, the upper and lower walls of each of said tank and said drum being arcuate and lying along portions of substantially concentric circles, an element located adjacent corresponding end edges of the upper and the lower walls and at one end of said washing drum, said element being carried by said machine for oscillating movement, means for oscillating said element whereby said element is adapted to push the fabric fed into said one end of said washing drum for discharge of the fabric at the opposite end thereof from between the corresponding opposite end edges of said washing drum.

9. A washing machine according to claim 8 wherein each of said tank and said drum has opposite end walls, said support means including at least one support wall disposed between one of the end walls of said tank and the corresponding end wall of said washing drum and carrying said blade groups for oscillating movement, and means coupling said element and said one support wall for joint oscillating movement of said element and said blades, said oscillating means including an electric motor.

* * * * *

UNITED STATES PATENT OFFICE

CERTIFICATE OF CORRECTION

Patent No. 3,950,968 Dated APRIL 20, 1976

Inventor(s) GINO DALLA VECCHIA

It is certified that error appears in the above-identified patent and that said Letters Patent are hereby corrected as shown below:

Claim 1, line 6, "space" should be --spaced--.

Claim 4, lines 3 and 4, the words "said each of said tank and said drum has opposite end walls," are repeated and should be cancelled.

Signed and Sealed this

Fifteenth Day of February 1977

[SEAL]

*Attest:*

RUTH C. MASON
*Attesting Officer*

C. MARSHALL DANN
*Commissioner of Patents and Trademarks*